United States Patent [19]

Kronfeld et al.

[11] 4,207,977

[45] Jun. 17, 1980

[54] APPLICATOR BRUSH PACKAGE

[75] Inventors: Jerome Kronfeld, Washington Crossing, Pa.; Garry Furst, West Newton, Mass.

[73] Assignee: American Brush Company, Inc., Stoughton, Mass.

[21] Appl. No.: 968,381

[22] Filed: Dec. 11, 1978

[51] Int. Cl.[2] ..... B65D 83/10

[52] U.S. Cl. ..... 206/361

[58] Field of Search ..... 206/361, 362, 362.4, 206/15.2, 15.3; 229/93

[56] References Cited

U.S. PATENT DOCUMENTS

| | | | |
|---|---|---|---|
| 1,938,376 | 12/1933 | Dietrichs | 206/361 |
| 2,552,741 | 5/1951 | Schumann | 206/361 |
| 2,763,367 | 9/1956 | Schumann | 206/362.4 |
| 2,956,676 | 10/1960 | Dgetluck | 206/361 |
| 2,963,150 | 12/1960 | Dgetluck | 206/361 |
| 2,984,401 | 5/1961 | Herkender | 206/361 |
| 3,426,989 | 2/1969 | Dgetluck | 206/361 |

*Primary Examiner*—Herbert F. Ross

*Attorney, Agent, or Firm*—Wolf, Greenfield & Sacks

[57] ABSTRACT

The brush package is formed of a cardboard sheet folded into a generally rectangular shape having first and second aligned opened ends. A bristle brush having bristles held by an outer band attached to a handle is mounted within the package. The cardboard at one end, has at least one folded over tab portion defining a stop edge which mates with an edge of said band to retain the brush in the cardboard when shipped and displayed.

6 Claims, 6 Drawing Figures

APPLICATOR BRUSH PACKAGE

BACKGROUND OF THE INVENTION

Various display packages are known for applicator brushes such as paint brushes. In some cases, rectangular, encircling plastic or cardboard casings having opened ends are wrapped around paint brushes. Various tab arrangements are used to retain the brushes within the packages. In many cases, special configurations, folding steps and loading procedures are used which can add to complexity and cost of packaging.

SUMMARY OF THE INVENTION

It is an object of this invention to provide a brush package which can be inexpensively produced and assembled at high speed and minimized complexity with the brush within the package.

Another object of this invention is to provide a package casing formed of a single sheet which uses sheet thickness as a stop to enable rapid loading of a brush within the casing and positive retention of the brush within the casing.

Still another object of this invention is to provide a brush package in accordance with the preceding objects which can have provision for viewing of the bristles of the brush and manual contact with the brush edge while still protecting the brush bristles from unnecessary damage and soiling during shipping, storage and handling.

According to the invention, a brush package casing for a brush which has a plurality of bristles bound to a handle by an encircling band with the band having a rear stop edge, comprises a cardboard sheet. The cardboard sheet is foled into a generally rectangular shape having first and second opened ends aligned with each other and defined by opposed top and bottom walls and side walls. At least one portion of the sheet is reversed on itself at a first end to form a casing stop edge by the thickness of the sheet. The top and bottom walls are spaced apart a predetermined distance so as to engage the brush rear stop edge with the sheet casing stop edge when the brush is positioned in the casing with the handle extending beyond the first end and the bristles extending toward or beyond the second end.

In a preferred embodiment, the second casing end has an angled opening to allow access to the bristle tips. Visual access to the brush band and bristle is preferably provided by a cutout window in one wall of the casing. The casing is preferably designed to be hung by the second end so that gravity retains the brush within the casing when on display.

It is a feature of this invention that paint brushes in particular can be rapidly packaged in casings of the invention at high speed. A simple flap folded on itself provides the stop action without the need for tab arrangements and interlocking of tabs with both top and bottom walls of casings. The bristles are visible. The cost of the package can be less than that of rigid plastic body sections as had been known in the prior art. Since cardboard is used, good quality printing can be inexpensively applied to the casings.

BRIEF DESCRIPTION OF THE DRAWINGS

The above and other objects, features and advantages of the present invention will be better understood by a reading of the following specification in conjunction with the attached drawings in which.

DESCRIPTION OF PREFERRED EMBODIMENTS

Figure 1:
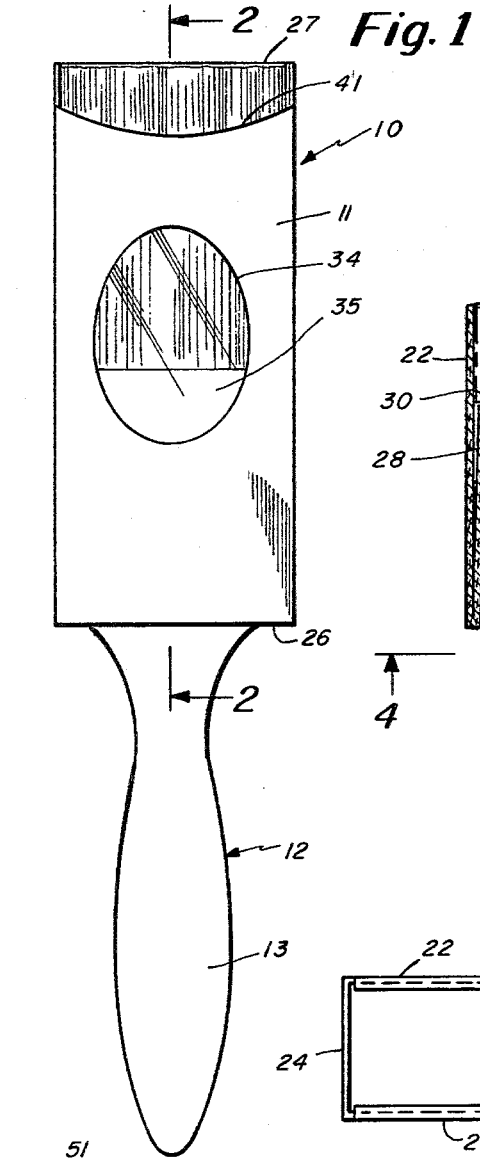
FIG. 1 is a front plan view of a brush package casing carrying a paint brush in accordance with a preferred embodiment of this invention.

With reference now to the drawings, a paint brush package is illustrated at 10 in FIG. 1 and has a casing 11 carrying a paint brush 12.

The paint brush 12 can be of any conventional design as for example with a wooden handle or hand grip portion 13 to which are attached bristles 14 bound thereto at least in part by a conventional thin metal band 15 as known in the brush art.

Figure 3:
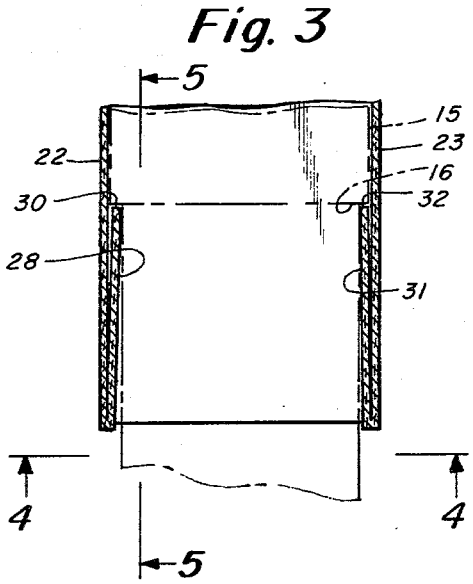
FIG. 3 is an enlarged cross sectional view through the lower portion of FIG. 2.
Figure 2:
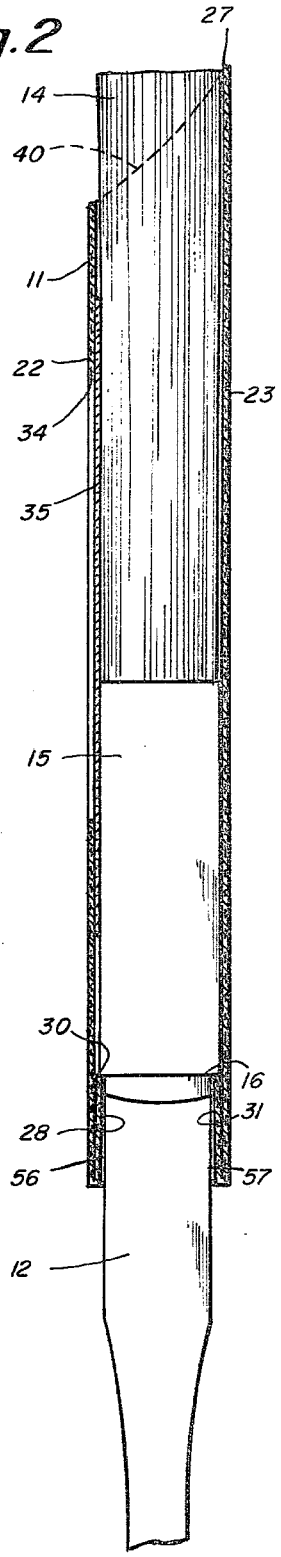
FIG. 2 is a cross sectional view through line 2—2 thereof.

The metal band 15 can be a thin band having a thickness of for example from 0.015" to 0.030" extending over and out from the handle portion as best shown in FIGS. 2 and 3 to define an edge 16 which acts as a rear stop edge in the package construction of this invention. The band is preferably a conventional paint brush band of single thickness but can be multiple layers. The edge 16 extends entirely about the brush handle. The brush of the preferred embodiment is a conventional two-inch paint brush although it can be a bristle brush or brush of any conventional type having a band encircling the handle and bristle portion and providing the rear stop edge.

The casing 11 is preferably formed of cardboard. Cardboard such as clay newsbark, solid sulfate or foil board can be used.

Figure 4:
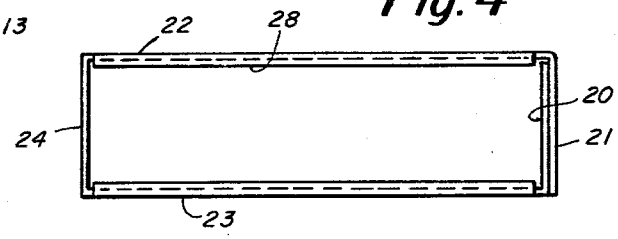
FIG. 4 is a view through a lower end of the casing taken along line 4—4 of FIG. 3.
Figure 5:
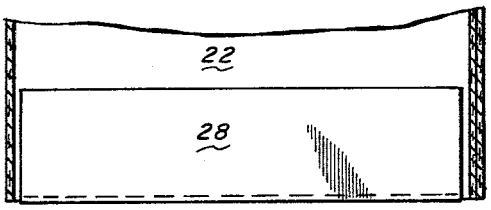
FIG. 5 is a cross sectional view taken through line 5—5 of FIG. 3.
Figure 6:
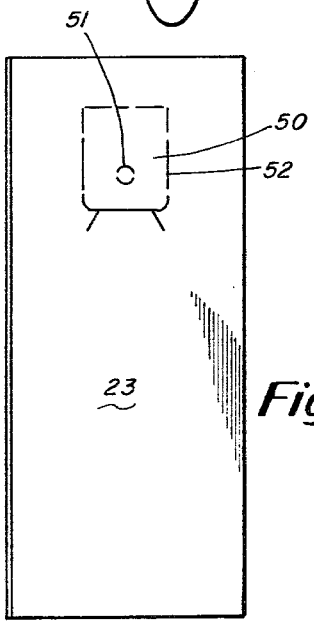
FIG. 6 is a rear view thereof.

In the preferred embodiment a solid sulfate cardboard having a thickness of 0.015" is used. The cardboard casing 11 is formed of a single sheet overlapped and adhered at end flaps 20 and 21 to form a top wall 22 opposed to a parallel bottom wall 23 and side walls formed by the composite of 20, 21 and 24 together defining a rectangular outline as best seen in FIG. 4. The casing is opened at ends 26 and 27. A first end 26 has a folded over flap 28 on the top wall 22 at its lower edge to form a stop edge 30. A corresponding flap 31 is preferably formed on the bottom wall 23 and folded over on the wall 23 as shown to form a stop edge 32 having a thickness corresponding to the thickness of the cardboard sheet. The walls 22 and 23 are spaced apart a sufficient distance to permit snug receipt of the paint brush therein as best shown in FIGS. 2 and 3.

The paint brush is inserted into the casing by passing the handle through the second end 27 and out of the first end 26 whereupon the stop edge 16 of the band 15 engages with the stop edges provided by each of flaps 28 and 31 as best shown in FIGS. 2 and 3. This provides a positive lock. Because of the nature of the bristles, they preferably expand somewhat when passed into the casing and act to provide some frictional resistance to withdrawal of the paint brush from the end 27 of the casing although this is not required in all constructions. The stop edges 30, 32 are preferably the same distance from end 26 so as to engage both sides of band 15. In some cases, side wall flaps and stop edges can also be used. A stop provided by one or more flaps can extend over various distances of mating with band edge 16. Preferably top and bottom flaps and edges as in the preferred embodiment are used.

In the preferred embodiment the top wall 22 has a cutout portion such as generally oval cutout portion 34 behind which is fastened a cellophane sheet 35 to provide visual access to both the band and the bristles of the brush when the package is in its assembled form.

The second end of the package at 27 is preferably cut at a first angularly arranged curved edge 40 on either side of the package and a second curved edge 41 across the top of the package. This provides visual access to the bristles as well as enabling a user to touch the bristle edge. On the other hand, during shipment, the portion of the bottom wall 23 of the casing which extends beyond the bristles at 27 protects the bristle edge.

Preferably a hang tab 50 is provided with a hole 51 and a cutout line 52. This enables the paint brush casing and brush package to be hung in a conventional display rack or elsewhere.

It is a key feature of this invention that the folded over portions 28 and 31 can be formed in a simple operation. For example, a blank for the casing can be formed as a flat sheet, the flaps 28 and 31 folded over and the blank then folded into its rectangular configuration. In some cases, glue can be inserted between the flaps 28 and 31 and the walls which they touch when bent over although this is not required. Note that the lower portion of FIG. 2 shows front and rear side edge portions 56 and 57 of the brush handle holding the flaps 28 and 31 in place in the absence of glue. The absence of glue enables a slight inward spring of the flaps toward the brush handle to engage the band 15.

The brush package casing of the present invention is easily adapted to high speed production. The casing can be formed by gluing the portions 20 and 21 after which a brush handle is introduced through the opened end 27 coaxially with the rectangular casing and stops its downward movement when the stop edge 16 of the band meets the stop edge 30, 32 provided by the flaps. The whole assembly operation is short and simple.

With a two-inch brush having bristles with a length of $2\frac{3}{4}''$ and a handle length of $5\frac{1}{2}''$, the casing can have an opening edge 26 to opening edge 27 length of 5 inches, a width across the top blank of 2-1/16 inches with a side wall or width of the rectangle of $\frac{5}{8}$ inches. The thickness of the edges 30 and 32 is 0.018" and the thickness of the edge 16 is 0.018".

Although specific dimensions and materials have been described, many variations are possible. In all cases it is preferred to use cardboard or paper products rather than plastic for the material of the casing in order to enhance printability and in some cases reduce cost. While it is preferred to use two facing, opposed, overlapped, reversely bent flaps such as 28 and 31 to form the stop edge, in some cases, a single flap can be used or flaps can be used on the side walls in addition to the top and bottom walls. Although the length of the flap is short as in the preferred embodiment, approximately $\frac{1}{4}$ inch, that length can vary greatly depending upon the construction of the brush handle and the desired final configuration.

Although it is preferred to have visual access and a hanging cutout, one or both of these can be eliminated in the final package. Similarly the angled end at 27 can be a simple square end although visual and manual access to the brush tips is preferred.

The printing used can be of conventional paper printing types as known in the art. All kinds of colors can be used as is known when printing paper or cardboard. While a paint brush formed of bristles has been described and shown, it should be understood that many variations are possible in the applicator portion of the brush. Nylon or natural bristles can be used as can foam plastics and other applicating means as known in the art. While the handle is described as wood, in some cases it can be plastic or other materials. Similarly the band 15 is preferably made of a conventional metallic thin strip but can be plastic or other materials.

What is claimed is:

1. A brush package casing for a brush having a plurality of bristles bound to a handle with an encircling band, said band defining a rear stop edge, said casing comprising a cardboard sheet folded into a generally rectangular shape having first and second opened ends aligned with each other and defined by a top wall, opposed bottom wall and side walls, at least one portion of said sheet being reversed on itself at said first end to form a casing stop edge, said top and bottom walls being spaced apart a predetermined distance so as to engage said band rear stop edge in face to face relationship with said casing stop edge when said brush is positioned in said casing with said handle extending beyond said first end and said bristles extending toward said second end.

2. A brush package casing in accordance with claim 1 and further comprising a second portion of said sheet being reversed on itself with said first and second reversed portions lying respectively on said top and bottom walls to form a casing stop edge with the edge of each reversed portion lying substantially the same distance from the first end of said casing.

3. A brush package casing in accordance with claim 2 and further comprising said second end having an angled portion to expose a portion of the bristles of said brush.

4. A brush package casing in accordance with claim 3 and further comprising a viewing cutout located in said top wall.

5. A brush package casing in accordance with claim 4 and further comprising a means for hanging said casing with said second end uppermost whereby gravity acts to aid in maintaining said brush in proper alignment in said casing.

6. In an applicator brush package comprising an encircling cardboard casing encircling the applicator and band portion of a brush defining an end edge and contained within said package, the improvement comprising, said cardboard defining an opened end through which said handle projects with the band of said brush located within said casing and maintained in said casing against axial movement in one direction by a folded over flap of said casing with said flap lying substantially parallel to a side wall portion of said casing and having an end stop edge abutting said brush end edge.

* * * * *